US005302504A

United States Patent [19]

Kida et al.

[11] Patent Number: 5,302,504

[45] Date of Patent: Apr. 12, 1994

[54] SILVER HALIDE COLOR PHOTOGRAPHIC LIGHT SENSITIVE MATERIAL CONTAINING A PYRAZOLOTRIAZOLE TYPE MAGENTA COUPLER

[75] Inventors: Shuji Kida; Hidenubu Ohya, both of Hino, Japan

[73] Assignee: Konica Corporation, Tokyo, Japan

[21] Appl. No.: 760,489

[22] Filed: Sep. 16, 1991

[30] Foreign Application Priority Data

Sep. 16, 1990 [JP] Japan ..... 2-249269
Sep. 16, 1990 [JP] Japan ..... 2-249270
Jan. 16, 1991 [JP] Japan ..... 3-014948

[51] Int. Cl.[5] ..... G03C 7/38

[52] U.S. Cl. ..... 430/558; 430/386; 430/387

[58] Field of Search ..... 430/558, 386, 387

[56] References Cited

U.S. PATENT DOCUMENTS 3,725,065 4/1973 Fadner, Jr. ..... 430/5
3,725,067 4/1973 Bailey et al. ..... 430/476
3,758,309 9/1973 Bailey et al. ..... 430/587
3,810,761 5/1974 Bailey et al. ..... 430/522
4,548,899 10/1985 Nakayama et al. ..... 430/558
4,684,603 8/1987 Nishijima et al. ..... 430/372
4,960,685 10/1990 Bowne ..... 430/505
4,990,430 2/1991 Harder et al. ..... 430/359
5,021,325 6/1991 Burns et al. ..... 430/387

FOREIGN PATENT DOCUMENTS 1-105249 4/1989 Japan ..... 430/558

*Primary Examiner*—Lee C. Wright
*Attorney, Agent, or Firm*—Frishauf, Holtz, Goodman & Woodward

[57] ABSTRACT

A silver halide color photographic material which comprises a coupler is disclosed. The coupler is represented by a formula I or II,

I

II

The meaning of each symbol is defined in the specification. The color photographic material of the invention gives a magenta image excellent in preserving stability.

4 Claims, No Drawings

SILVER HALIDE COLOR PHOTOGRAPHIC LIGHT SENSITIVE MATERIAL CONTAINING A PYRAZOLOTRIAZOLE TYPE MAGENTA COUPLER

BACKGROUND OF THE INVENTION

This invention relates to a silver halide color photographic light sensitive material containing a magenta coupler and, particularly, to a silver halide color photographic light sensitive material on which a color image excellent in color reproducibility can be obtained by containing a novel pyrazolotriazole type magenta coupler therein.

In silver halide color photographic light sensitive materials, a yellow coupler, a magenta coupler and a cyan coupler are commonly used and, among them in particular, a pyrazolone type compound is used for a magenta coupler. However, the dyes produced of pyrazolone couplers have been demanded to be improved, because they have an undesirable side-absorption.

With the purpose of solving the above-mentioned problem, U.S. Pat. Nos. 3,725,065, 3,810,761, 3,758,309 and 3,725,067 propose pyrazoloazole type couplers. However, there are still earnest demands for improving the color reproducibility, because the compounds proposed in the above-given patent specification still do not satisfy the demands.

For improving the color reproducibility, many pyrazolotriazole type couplers have been developed and it was discovered that a desirable color reproducibility can be obtained by a IH pyrazolo- [5,1-c] [1,2,4] triazole type magenta coupler having a phenyl group substituted from the 2nd, 4th and 6th positions to the 3rd position. The couplers of this type are described in Japanese Patent Publication Open to Public Inspection (hereinafter referred to as Japanese Patent O.P.I. Publication) Nos. 56-133734/1981, 61-141446/1986 and 61 292143/1986 and U.S. Pat. No. 4,942,117. However, the couplers described therein have the problems that color developability is unsatisfactory and fogging is increased so that they cannot be used for practical purposes.

SUMMARY OF THE INVENTION

The objects of the invention are to solve the abovedescribed problems. To be more specific, it is an object of the invention to provide a silver halide color photographic light sensitive material improved on color reproducibility. Another object of the invention is to provide a silver halide color photographic light sensitive material capable of obtaining a color image having both of a high maximum density and a high light-sensitive speed. A further object of the invention is to provide a silver halide color photographic light sensitive material reducing a low fog production. Yet another object of the invention is to provide a silver halide color photographic light sensitive material capable of forming a magenta image excellent in preserving stability.

The silver halide color photographic light sensitive material of the invention contains a coupler represented by the following formula I or II.

Formula I

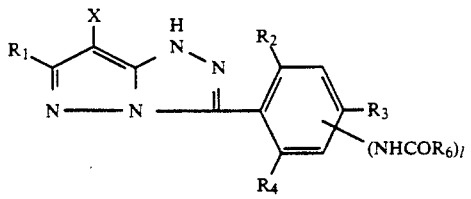

Formula II

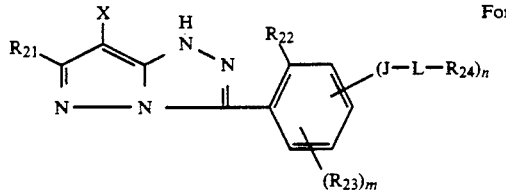

In the above-given formulas I and II, $R_1$ represents a primary alkyl group; $R_2$, $R_3$ and $R_4$ represent each an alkyl group, an alkoxy group or a halogen atom; and $R_6$ represents a straight-chained or branched non-substituted alkyl group or a substituted phenoxy alkylene group having a substituent such as an alkyl group, an alkoxy group, a halogen atom, an alkyloxycarbonyl group, an aryloxycarbonyl group, an acylamino group or a cyano group;

$R_{21}$ represents a hydrogen atom or a substituent; $R_{22}$ and $R_{23}$ represent each a substituent; J represents —N($R_{25}$)—CO—$R_{26}$—or —CO—N($R_{25}$)—$R_{26}$—in which $R_{25}$ represents a hydrogen atom, an alkyl group, an aryl group or a heterocyclic group and $R_{26}$ represents an alkylene group or an arylene group; L represents a coupling group having a carbonyl or sulfonyl group; and $R_{24}$ represents an organic group;

X represents a hydrogen atom or a releasing group; m is an integer of 0, 1 or 2; n is an integer of 1 or 2; and l is an integer of 1 or 2.

The couplers of the invention will further be detailed.

In the above-given formulas, $R_1$ represents a primary alkyl group including, for example, a methyl group, an ethyl group, an n-propyl group, an n-butyl group, an n-pentyl group, an n-decyl group, an n-dodecyl group and a 3-(2,4-di-t-amylphenoxy)propyl group. Among them, the preferable examples for $R_1$ include a methyl group.

$R_2$, $R_3$ and $R_4$ represent each an alkyl group such as a methyl group, an ethyl group and an n-propyl group, an alkoxy group such as a methoxy group and an ethoxy group, or a halogen atom such as a fluorine atom and a chlorine atom. Among them, the preferable examples for $R_2$, $R_3$ and $R_4$ include, for example, an alkyl group and the most preferable example therefor is a methyl group, provided that $R_2$, $R_3$ and $R_4$ may be the same with or the different from each other and that all of $R_2$, $R_3$ and $R_4$ are preferable to be the same. The most preferable example for $R_2$, $R_3$ and $R_4$ is that all of $R_2$, $R_3$ and $R_4$ represent each a methyl group.

$R_6$ represents a substituted phenoxy alkylene group having a substituent selected from the group consisting of an alkyl group, an alkoxy group, a halogen atom, an alkyloxy carbonyl group, an aryloxy carbonyl group, an acylamino group or a cyano group. Among them, the preferable examples for $R_6$ are represented by the following formula I-2.

Formula I-2

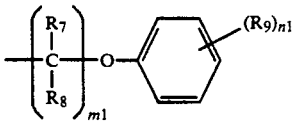

In the above-given formula, $R_7$ and $R_8$ represent each a hydrogen atom or an alkyl group such as a methyl group, an ethyl group, an n-propyl group, an i-propyl group, an n-butyl group, an n-hexyl group, an n-decyl group and an n-dodecyl group; provided, $R_7$ and $R_8$ may be the same as or the different from each other; $m_1$ is an integer of 1 to 5 and, preferably, 1 to 3, provided, $R_7$ and $R_8$ may be the same as or the different from each other when ml is not less than 2; $R_9$ represents an alkyl group such as a methyl group, an ethyl group, an n-propyl group, an i-propyl group, an n-butyl group, a t-butyl group, an n-amyl group, a t-amyl group, an n-decyl group, an n pentadecyl group and a 2-methyltridecyl group, an alkoxy group such as a methoxy group, an ethoxy group and an n-butoxy group, a halogen atom such as a fluorine atom, a chlorine atom and a bromine atom, an alkyloxycarbonyl group such as a methoxycarbonyl group, an ethoxycarbonyl group, an n-propoxycarbonyl group, an n-butoxy carbonyl group, an i-butoxycarbonyl group and an n-dodecyloxy carbonyl group, an aryloxycarbonyl group such as a phenyloxycarbonyl group and a 2,4 di-t-amylphenoxycarbonyl group, an acylamino group such as an acetylamino group, a propionylamino group, an n-decanoylamino group, an α-(2,4-di-t-amylphenoxy) butylamido group, and a cyano group and, among them, the preferable examples for $R_9$ include an alkyl group and the most preferable example is a t-amyl; and nl is an integer of 1 to 5 and, preferably, 1 or 2.

The typical examples for $R_6$ represented by formula I-2 may be given as follows.

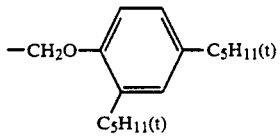

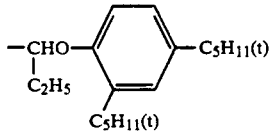

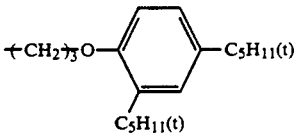

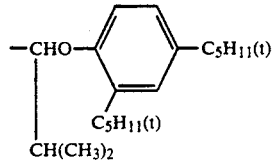

-continued

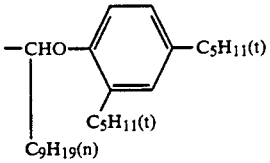

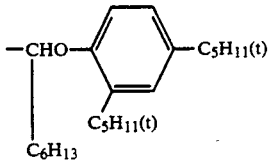

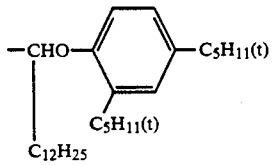

Another example for $R_6$ may be given as a straight-chained or branched non-substituted alkyl group having desirably 1 to 30 carbon atoms and preferably 8 to 18 carbon atoms. The typical straight-chained alkyl groups include, for example, a methyl group, an ethyl group, an n-propyl group, an n-butyl group, an n-pentyl group, an n-hexyl group, an n-decyl group, an n-dodecyl group, an n-tridecyl group, an n-tetradecyl group, an n-pentadecyl group, an hexadecyl group and an n-tetracocyl group. Typical branched alkyl groups include, for example, an i-propyl group, a t-propyl group, an i-butyl group, a neopentyl group, a 2-ethylpentyl group, a 1-methylundecyl group, a 1-ethyldecyl group and a 1-heptyldecyl group. The most preferable example for $R_6$ is a straightchained non-substituted alkyl group having 13 to 15 carbon atoms.

$R_{21}$ represents a hydrogen atom or a substituent. The substituents include, preferably, a straight-chained or branched alkyl group having 1 to 18 carbon atoms, such as a methyl group, an ethyl group, an i-propyl group, a t-butyl group, a neopentyl group and a pentadecyl group; a cycloalkyl group having 3 to 10 carbon atoms, such as a cyclopropyl group, a cyclopentyl group and a cyclohexyl group; an alkoxy group such as a methoxy group and an ethoxy group; an aryloxy group such as a phenoxy group and a naphthyloxy group; an aryl group such as a phenyl group and a naphthyl group; an alkylthio group such as a methylthio group and a dodecylthio group; an arylthio group such as a phenylthio group; an acylamino group such as an acetylamino group and a benzoylamino group; a ureido group such as a phenylcarbamoylamino group and a dimethylcarbamoylamino group; an alkoxycarbonylamino group such as an ethoxycarbonylamino group; an aryloxycarbonylamino group such as a phenoxycarbonylamino group; and an amino group such as a dimethylamino group and an anilino group. The above-given groups may have each a further substituent. $R_{21}$ represents preferably an alkyl group and most preferably a methyl group.

The preferable substituents represented by $R_{22}$ and $R_{23}$ include, for example, a straight-chained or branched alkyl group such as a methyl group or an ethyl group; an aryl group such as a phenyl group; an alkoxy group such as a methoxy group and an ethoxy group; an aryloxy group such as a phenoxy group; an acylamino group such as an acetylamino group and a benzoylamino group; a ureido group such as a phenylcarbamoylamino group and a dimethylcarbamoylamino group; an amino group such as a dimethylamino group and an anilino group; a halogen atoms such as a fluorine atom, a chlorine atom and a bromine atom; a nitro group; a cyano group; a hydroxy group; a carboxy group; and a carbamoyl group such as a phenylcarbamoyl group and a butylcarbamoyl group. The above-given groups may have a further substituent. Among them, it is particularly preferable when $R_{22}$ and $R_{23}$ are the same groups.

m is preferably an integer of 2.

J represents —N($R_{25}$)CO—$R_{26}$—or —CON($R_{25}$)—$R_{26}$—, in which $R_{25}$ represents a hydrogen atom, an alkyl group, an aryl group or a heterocyclic group and $R_{26}$ represents an alkylene group or an arylene group.

The alkyl groups represented by $R_{25}$ include, for example, a methyl group, an ethyl group, an isopropyl group, a t-butyl group and a dodecyl group. The aryl groups represented by $R_{25}$ include, for example, a phenyl group or a naphthyl group. The alkyl groups or the aryl groups each represented by $R_{25}$ include each of those having a substituent.

J includes, preferably, —NHCO—$R_{26}$—.

The alkylene groups represented by $R_{26}$ include, for example. a methylene group, an ethylene group, a propylene group and a butylene group. These groups are each also allowed to have a substituent such as an alkyl group as the side chain thereof.

The arylene groups represented by $R_{26}$ include, for example, a phenylene group and so forth. These groups are each also allowed to have a substituent.

The preferable $R_{26}$ represents an alkylene group.

The coupling groups each having a carbonyl unit, which are represented by L, include, for example, —CO—, —CO—O—, —O— CO—, —NHCO—, —CONH—and —NHCONH—. The coupling groups each having a sulfonyl unit include, for example, —$SO_2$—, —$NHSO_2$—, —$SO_2NH$—and —NH-$SO_2NH$—.

The organic groups each represented by $R_{24}$ include, preferably, an alkyl group or an aryl group and, particularly, the alkyl groups.

n is preferably an integer of 1.

X represents a hydrogen atom or a releasing group. The releasing groups are those capable of releasing upon coupling reaction with the oxidized products of a color developing agent, which include, for example, a halogen atom, an alkoxy group, an aryloxy group, an acyloxy group,:an arylthio group, an alkylthio group, a sulfonamido group and an acylamino group.

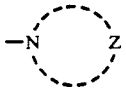

wherein Z represents a group of atoms necessary to form a 5- or 6-membered ring selected from the group consisting of a carbon atom, an oxygen atom, a nitrogen atom and a sulfur atom, together with a nitrogen atom.

The typical examples of the releasing groups will be given below.

Halogen atoms: an atom of chlorine, bromine or fluorine;

Alkoxy groups:

an ethoxy, benzyloxy, ethylcarbamoylmethoxy or tetradecylcarbamoylmethoxy group;

Aryloxy groups:

a phenoxy, 4-methoxyphenoxy or 4-nitophenoxy group;

Acyloxy groups:

an acetoxy, myristoyloxy or benzoyloxy group;

Arylthio groups:

a phenylthio, 2-butoxy-5-octylphenylthio or 2,5dihexyloxyphenylthio group;

Alkylthio groups:

a methylthio, cctylthio, hexadecylthio, benzylthio, 2-(diethylamino) ethylthio, ethoxycarbonyl methylthio, ethoxyethylthio or phenoxyethylthio group;

Sulfonamido groups:

a methanesulfonamido or benzenesulfonamido group; and

Acylamino groups:

a heptafluorobutanamido or pentachlorophenyl carbonylamino group.

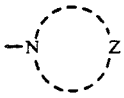

The releasable group represented by the formula,

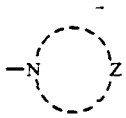

includes, for example, the following groups.

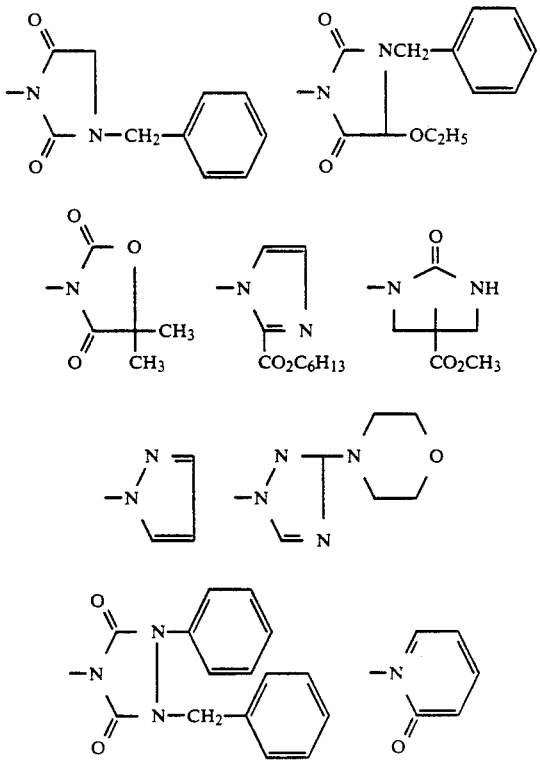

-continued

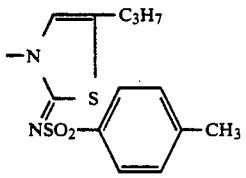

The releasing groups include, preferably, halogen atoms and, particularly among them, a chlorine atom.

The couplers of the invention preferably include those represented by the following formula;

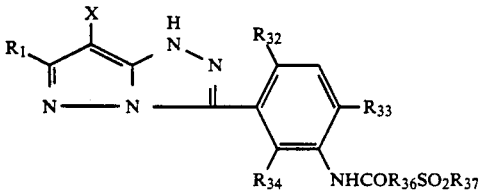

wherein $R_1$ represents a primary alkyl group and preferably a methyl group; X represents a halogen atom including, preferably, a chlorine atom; $R_{32}$, $R_{33}$ and $R_{34}$ represent each a lower alkyl group including, preferably, a methyl group; $R_{36}$ represents an alkylene group; and $R_{37}$ represents an alkyl group.

The typical examples of the couplers of the invention will be given below.

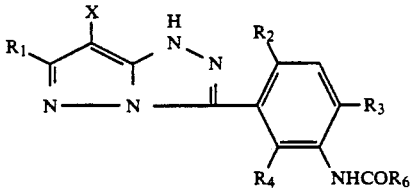

| No. | $R_1$ | X | $R_2$ | $R_3$ | $R_4$ | $R_6$ |
|---|---|---|---|---|---|---|
| 101 | $CH_3$ | Cl | $CH_3$ | $CH_3$ | $CH_3$ | 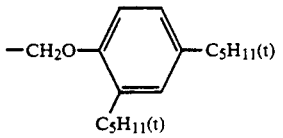 |
| 102 | $CH_3$ | Cl | $CH_3$ | $CH_3$ | $CH_3$ | 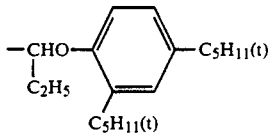 |
| 103 | $CH_3$ | Cl | $CH_3$ | $CH_3$ | $CH_3$ | 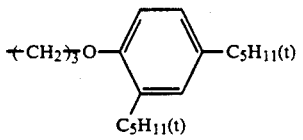 |
| 104 | $CH_3$ | Cl | $CH_3$ | $CH_3$ | $CH_3$ | 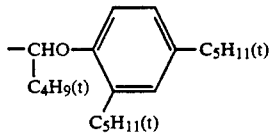 |
| 105 | $CH_3$ | Cl | $CH_3$ | $CH_3$ | $CH_3$ | 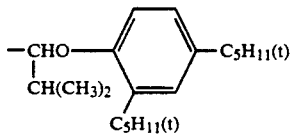 |
| 106 | $CH_3$ | Cl | $CH_3$ | $CH_3$ | $CH_3$ | 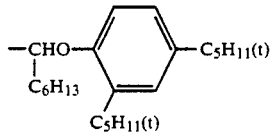 |

-continued
| | | | | | | |
|---|---|---|---|---|---|---|
| 107 | $CH_3$ | Cl | $CH_3$ | $CH_3$ | $CH_3$ | 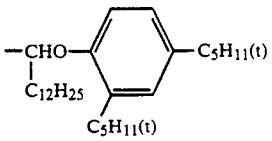 |
| 108 | $CH_3$ | Cl | $CH_3$ | $CH_3$ | $CH_3$ | 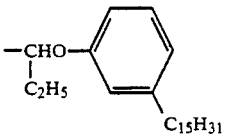 |
| 109 | $CH_3$ | Cl | $CH_3$ | $CH_3$ | $CH_3$ | 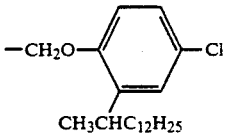 |
| 110 | $CH_3$ | Cl | $CH_3$ | $CH_3$ | $CH_3$ | 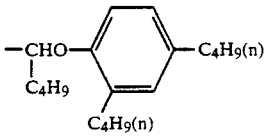 |
| 111 | $CH_3$ | Cl | $CH_3$ | $CH_3$ | $CH_3$ | 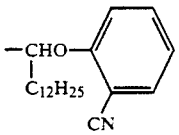 |
| 112 | $C_2H_5$ | Cl | $CH_3$ | $CH_3$ | $CH_3$ | 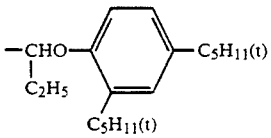 |
| 113 | $C_{12}H_{25}$ | Cl | $CH_3$ | $CH_3$ | $CH_3$ | 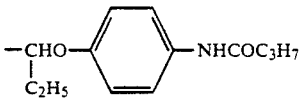 |
| 114 | $CH_3$ | Cl | $C_2H_5$ | $C_2H_5$ | $C_2H_5$ | 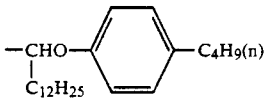 |
| 115 | $CH_3$ | Cl | $C_2H_5$ | $C_2H_5$ | $C_2H_5$ | 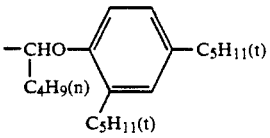 |
| 116 | $CH_3$ | Cl | $OCH_3$ | $OCH_3$ | $OCH_3$ | 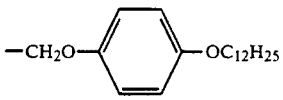 |
| 117 | $CH_3$ | Cl | $OCH_3$ | $OCH_3$ | $OCH_3$ | 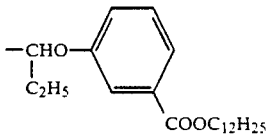 |

-continued
| | | | | | | |
|---|---|---|---|---|---|---|
| 118 | $CH_3$ | Cl | Cl | Cl | Cl | 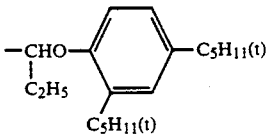 |
| 119 | $CH_3$ | Cl | $CH_3$ | $C_4H_9(t)$ | $CH_3$ | 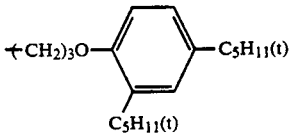 |
| 120 | $CH_3$ | Cl | $CH_3$ | $OCH_3$ | $OC_2H_5$ | 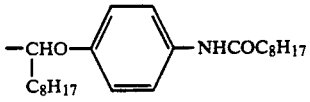 |
| 121 | $CH_3$ | Cl | F | F | F | 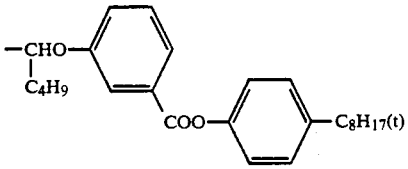 |
| 122 | $CH_3$ | 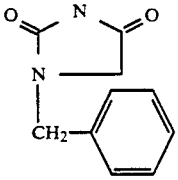 | $CH_3$ | $CH_3$ | $CH_3$ | 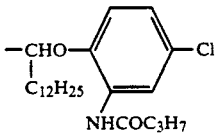 |
| 123 | $CH_3$ | 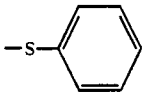 | $CH_3$ | $CH_3$ | $CH_3$ | 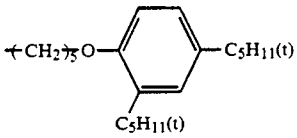 |
| 124 | $CH_3$ | Cl | $CH_3$ | $CH_3$ | $CH_3$ | 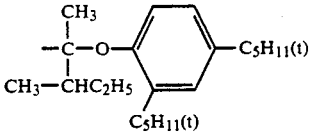 |
| 125 | $CH_3$ | 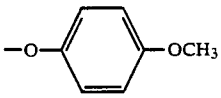 | $CH_3$ | $CH_3$ | $CH_3$ | 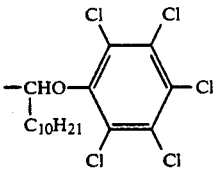 |
| 126 | 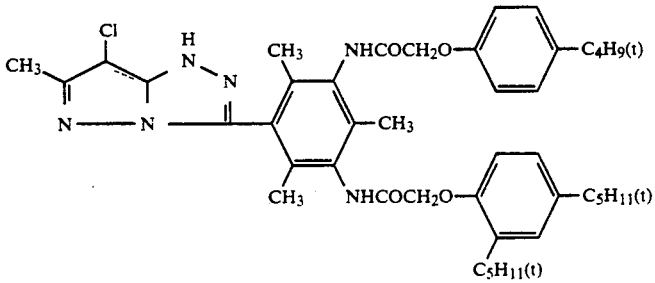 | | | | | |
| 201 | $CH_3$ | Cl | $CH_3$ | $CH_3$ | $CH_3$ | $C_{13}H_{27}(n)$ |
| 202 | $CH_3$ | Cl | $CH_3$ | $CH_3$ | $CH_3$ | $C_{14}H_{29}(n)$ |
| 203 | $CH_3$ | Cl | $CH_3$ | $CH_3$ | $CH_3$ | $C_{15}H_{31}(n)$ |
| 204 | $CH_3$ | Cl | $CH_3$ | $CH_3$ | $CH_3$ | $C_{17}H_{35}(n)$ |

-continued

| | | | | | | |
|---|---|---|---|---|---|---|
| 205 | $CH_3$ | Cl | $CH_3$ | $CH_3$ | $CH_3$ | $C_{11}H_{23}(n)$ |
| 206 | $C_2H_5$ | Cl | $CH_3$ | $CH_3$ | $CH_3$ | $C_{14}H_{29}(n)$ |
| 207 | $C_{12}H_{25}$ | Cl | $CH_3$ | $CH_3$ | $CH_3$ | $C_5H_{11}(n)$ |
| 208 | $C_{12}H_{25}$ | Cl | $CH_3$ | $CH_3$ | $CH_3$ | $C_3H_7(n)$ |
| 209 | $CH_3$ | Cl | $CH_3$ | $CH_3$ | $CH_3$ | $-CH(CH_3)C_{10}H_{21}$ |
| 210 | $CH_3$ | Cl | $CH_3$ | $CH_3$ | $CH_3$ | $-CH(C_7H_{15})C_9H_{19}$ |
| 211 | $C_{12}H_{25}$ | Cl | $CH_3$ | $CH_3$ | $CH_3$ | $-CH_2CH(CH_3)_2$ |
| 212 | $CH_3$ | Cl | $C_2H_5$ | $C_2H_5$ | $C_2H_5$ | $-C_{13}H_{27}(n)$ |
| 213 | $CH_3$ | Cl | $OCH_3$ | $OCH_3$ | $OCH_3$ | $-C_{15}H_{31}(n)$ |
| 214 | $C_{10}H_{21}$ | Cl | Cl | Cl | Cl | $-CH_2CH(C_2H_5)C_3H_7$ |
| 215 | $CH_3$ | Cl | $CH_3$ | $C_4H_9(t)$ | $CH_3$ | $-C_{15}H_{31}(n)$ |
| 216 | $CH_3$ | Cl | $CH_3$ | $OCH_3$ | $OC_2H_5$ | $-CH(C_7H_{15})C_9H_{19}$ |
| 217 | $CH_3$ | Cl | F | F | F | $-C_{12}H_{25}(n)$ |
| 218 | $CH_3$ | 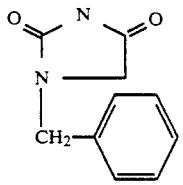 | $CH_3$ | $CH_3$ | $CH_3$ | $-C_{13}H_{27}(n)$ |
| 219 | $CH_3$ | 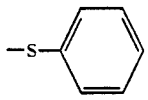 | $CH_3$ | $CH_3$ | $CH_3$ | $-C_{17}H_{35}(n)$ |
| 220 | $CH_3$ | 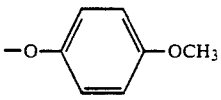 | $CH_3$ | $CH_3$ | $CH_3$ | $-CH(CH_3)C_{10}H_{21}$ |
| 221 | $CH_3$ | F | $CH_3$ | $CH_3$ | $CH_3$ | $-C_{13}H_{27}(n)$ |
| 222 | $CH_3$ | Cl | $OCH_3$ | $OCH_3$ | $OCH_3$ | $-CH(C_7H_{15})C_9H_{19}$ |
| 223 | 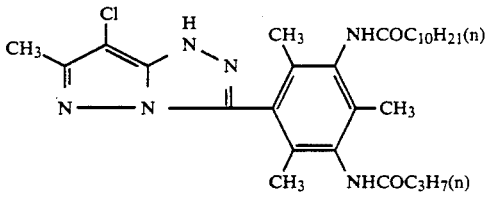 | | | | | |
| 224 | 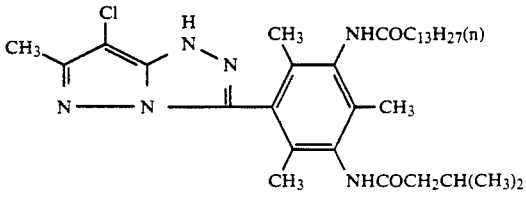 | | | | | |

-continued
Formula 7
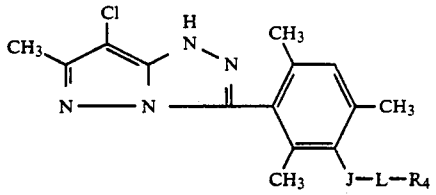
| | —J—L—$R_4$ |
|---|---|
| 301 | —$NHCOCH_2CH_2SO_2C_{16}H_{33}$ |
| 302 | —$NHCOCH(CH_3)CH_2SO_2C_{12}H_{25}$ |
| 303 | —$NHCOCH(CH_3)CH_2SO_2CH_2CH(C_6H_{13})(C_8H_{17})$ |
| 304 | —$NHCOCH_2NHCOCH(C_2H_5)O$—($C_5H_{11}(t)$)($C_5H_{11}(t)$) |
| 305 | —NHCO—$C_6H_4$—$CONH(CH_2)_4O$—$C_6H_3$($C_5H_{11}(t)$)($C_5H_{11}(t)$) |
| 306 | —$CONHCH_2CH_2NHSO_2C_{12}H_{25}$ |
| 307 | —CONH—$C_6H_4$—$SO_2NHC_{14}H_{29}$ |
| 308 | —$CON(CH_3)CH_2CH_2CH_2CONH$—$C_6H_4$—$OC_{14}H_{29}$ |
Formula 8
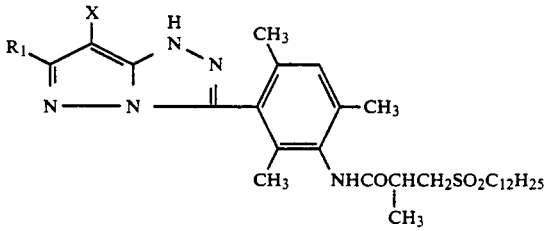
| | $R_1$ | X |
|---|---|---|
| 309 | —$CH_3$ | —F |
| 310 | —$OC_2H_5$ | —Cl |

-continued
| | | |
|---|---|---|
| 311 | $-C_2H_7(i)$ | 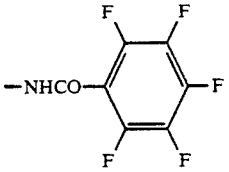 |
| 312 | $-C_4H_9(t)$ | $-NHSO_2C_4H_9$ |
| 313 | $-SCH_3$ | $-OCH_2CH_2OH$ |
| 314 | $-CH_3$ | 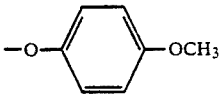 |
| 315 | 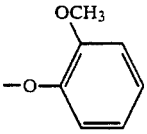 | 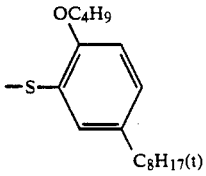 |
| 316 | $-CH_3$ | $-SCH_2CH_2COOH$ |
| 317 | $-C_{15}H_{31}$ | 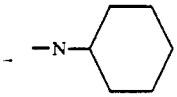 |
| 318 | 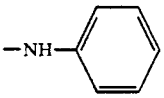 | 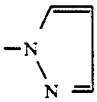 |
| 319 | 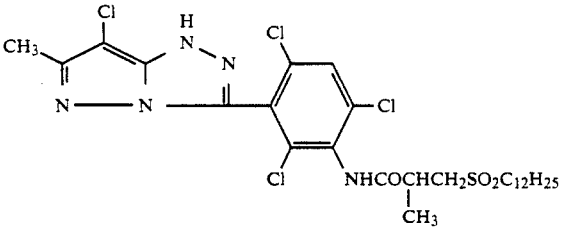 | |
| 320 | 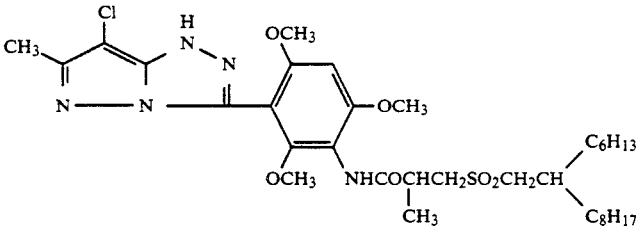 | |
| 321 | 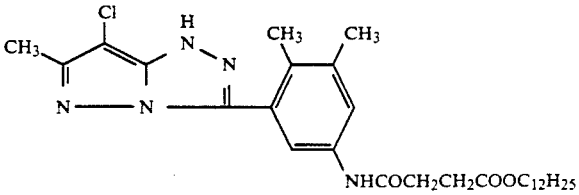 | |

-continued

322

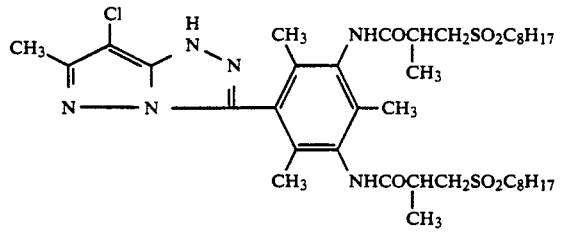

The typical synthesis examples of the couplers of the invention will now be given below.

[Synthesis example] Synthesis of exemplified compound 102

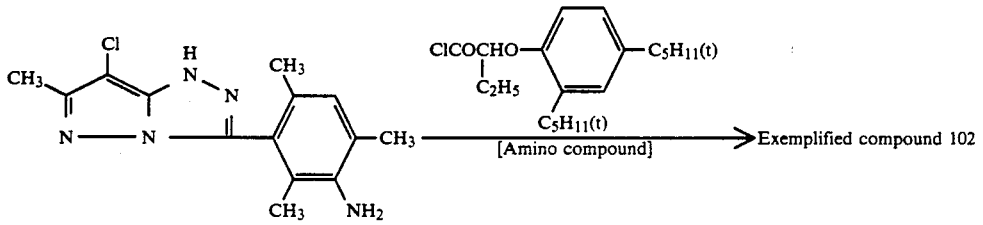

The amino compound of 29 g (mentioned above), which was synthesized in the same procedures described in the synthesis example given in Japanese Patent O.P.I. Publication No. 1-263640/1989, 15 ml of pyridine and 180 ml of acetonitrile were each stirred up at a room temperature, and 36 g of the above-mentioned acid chloride was added thereinto. After the resulting mixture was stirred at room temperature for 4 hours, the mixture was poured into 1.5 liters of an aqueous dilute hydrochloric acid solution. After an extraction was made with ethyl acetate, the resulting organic layer was washed with water and was then dried up with magnesium sulfate. After the magnesium sulfate was removed and the solvent was distilled off, a residue was obtained. After the resulting residue was refined in a column chromatography (with a developing solvent of ethyl acetate/hexane=⅓), the resulting refined matter was crystallized with acetonitrile and the crystallized matter was further recrystallized with acetonitrile. The yield therefrom was 38 g and the product was identified to be the objective matter in NMR and mass-spectrometry.

[Synthesis example] Synthesis of exemplified compound 203

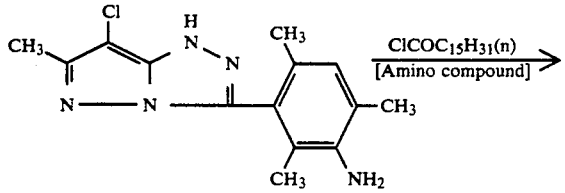

Exemplified compound 203

The amino compound of 29 g (mentioned above), which was synthesized in the same procedures described in the synthesis example given in Japanese Patent O.P.I. Publication No. 1-263640/1989, 15 ml of pyridine and 180 ml of acetonitrile were each stirred up at a room temperature, and 29 g of the above-mentioned acid chloride was added thereinto. After the resulting mixture was stirred at room temperature for 4 hours, the mixture was poured into 1.5 liters of an aqueous dilute hydrochloric acid solution. After an extraction was made with ethyl acetate, the resulting organic layer was washed with water and was then dried up with magnesium sulfate. After the magnesium sulfate was removed and the solvent was distilled off, a residue was obtained. After the resulting residue was refined in a column chromatography (with a developing solvent of ethyl acetate/hexane=⅓), the resulting refined matter was crystallized with acetonitrile. The yield therefrom was 43 g and the product was identified to be the objective matter in NMR and mass-spectrometry.

[Synthesis example] Synthesis of exemplified compound 302

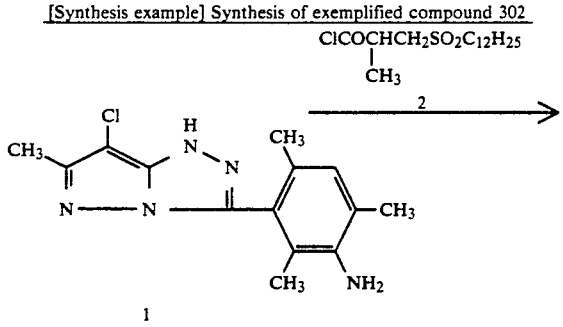

Exemplified compound 302

The above-given 1 of 14.5 g, which was synthesized in the same procedures described in the synthesis example given in Japanese Patent Application No. 1-263640/1989, 7.5 ml of pyridine and 70 ml of acetonitrile were added with 17.0 g of 2. After the mixture was stirred at room temperature for 4 hours, an extraction was made therefrom by adding 300 ml of an aqueous dilute hydrochloric acid solution and 150 ml of ethyl acetate. After the resulting ethyl acetate layer was washed with water and then the ethyl acetate was distilled off under reduced pressure, the resulting matter was dried up. The resulting residue was recrystallized with a mixed solvent comprising ethyl acetate and hexane, so that 21 g of exemplified compound (2) could be obtained. The structure of the resulting product was identified in NMR and a mass-spectrometry.

Also, the other compounds could readily be synthesized in the same procedures.

The couplers each relating to the invention may usually be used within the range of $1\times10^{-3}$ mols to 1 mol and, preferably, $1\times10^{-2}$ mols to $8\times10^{-1}$ mols per mol of silver halide to be used.

The couplers of the invention may be added into, preferably, a silver halide emulsion layer.

The couplers of the invention may also be used together with other kinds of magenta couplers in combination, provided that the effects of the invention cannot be spoiled.

The silver halide emulsions applicable to the invention. are allowed to contain any one of silver halides applicable to any ordinary type silver halide emulsions, such as silver bromide, silver iodobromide, silver iodochloride, silver chlorobromide, silver chloroiodobromide and silver chloride.

The silver halide grains may be those having a uniform distribution of silver halide composition in the grains or the core/shell type grains having any silver halide grain compositions each different between the inside thereof and the surface layer thereof.

The silver halide grains may be those forming a latent image on the surface thereof or those forming it mainly inside thereof.

The silver halide grains are also allowed to have a regular crystal form such as a cube, an octahedron and a tetradecahedron or a irregular crystal form such as globular and tabular forms. These grains are allowed to have any proportions of (b 100) planes to (111) planes.

The grains may have either any complexes of the above-mentioned crystal forms or any mixtures of various crystal forms.

The silver halide grains may be used when they have a grain-size within the range of 0.05 to 30 μm and, preferably, 0.1 to 20 μm.

It is allowed to use a silver halide emulsion having any grain-size distributions. That is to say, it is allowed to use either an emulsion having a wide grain-size distribution (which is referred to as a polydisperse type emulsion) or an emulsion having a narrow grain-size distribution (which is referred to as a monodisperse type emulsion), independently or in combination. It is also allowed to use a mixture of a polydisperse type emulsion and a monodisperse type emulsion.

In the invention, it is allowed to use a colored coupler having a color-compensation effect and a compound capable of releasing a photographically useful fragment such as a development inhibitor, a development accelerator, a bleach accelerator, a developing agent, a silver halide solvent, a color tone controller, a foggant, an antifoggant, a chemical sensitizer, a spectral sensitizer and a desensitizer upon coupling reaction with the oxidized products of a developing agent.

Among them, it is also allowed to use the so-called DIR compounds each capable of releasing a development inhibitor while a development is being carried out and capable of improving both of the image sharpness and graininess of an image.

The above-mentioned DIR compounds include, for example, a compound coupled directly to an inhibitor in the coupling position; the so-called timing DIR compounds in which an inhibitor is coupled to a coupling position through a divalent group and so coupled as to release an inhibitor upon intramolecular nucleophilic reaction or intramolecular electron-transfer reaction inside a group released upon coupling reaction; and also include a compound so coupled as to release an inhibitor upon reaction of a group, which was already released by a coupling reaction, with a further molecule of the oxidized products of a developing agent. After the group was released, it is allowed to use an inhibitor having a diffusibility and another inhibitor having not so much diffusibility, independently or in combination, so as to meet the desired uses.

The DIR compounds react each with the oxidized products of an aromatic primary amine type developing agent and, further, a colorless coupler incapable of forming any dyes, that may also be referred to as a competing coupler, may be used together with a dye-forming coupler in combination.

In the invention, known acylacetanilide type couplers can preferably be used as yellow couplers. Among them, both of the benzoylacetanilide and pivaloylacetanilide types of compounds may advantageously be used.

Both of the phenol and naphthol types of couplers may commonly be used as cyan couplers.

A color-fog inhibitor can be used for preventing a stained color, a deteriorated image sharpness and a roughened graininess each caused by mobilizing the oxidized products of a developing agent or an electron-transferring agent between the emulsions (that is, between the same color-sensitive layers and/or between the different color-sensitive layers) of a light sensitive material.

To a light sensitive material, an image stabilizer may be so applied as to prevent a dye image from being deteriorated. The compounds preferably applied thereto are given in "Research Disclosure", No. 17643, Article VII-J.

In a light sensitive material, the hydrophilic colloidal layers such as a protective layer and an interlayer are also allowed to contain a UV absorbent so as to prevent the light sensitive material from being fogged by an electrostatic discharge generated by a frictional electricity given to the light sensitive material and also to prevent an image from being deteriorated by Uv rays.

During the storage of a light sensitive material, a magenta dye-forming couplers or the like may be deteriorated by formalin. For preventing the light sensitive material from deteriorating, a formalin scavenger may be used in the light sensitive material.

The invention can preferably be applied to a color negative film, a color paper and a color reversal film. A preferable example applied with the invention is a color reversal film.

A color negative film, a color paper and a color reversal film are each usually comprised of blue-sensitive, green-sensitive and red-sensitive silver halide emulsion layers and non-light-sensitive hydrophilic colloidal layers. However, the invention shall not be limited at all to any layers arrangements onto a support.

When making use of the light sensitive materials of the invention, a dye-image can be obtained by carrying out a color photographic process after exposing the light sensitive material to light.

The color photographic process is comprised of a color developing step, a bleaching step, a fixing step, and a washing step and, if required, a stabilizing step. It is allowed to carry out a bleach fixing step in which a monobath type bleach-fixing solution is used in place of both of the processing step in which a bleaching solution is used and the other processing step in which a fixing solution is used. It is also allowed to carry out a monobath type processing step in which a color developing step, a bleaching step and a fixing step can be performed altogether at a time.

EXAMPLES

Next, the invention will be detailed with reference to the examples thereof. It is, however, to be understood that the invention shall not be limited thereto.

EXAMPLE 1

The magenta couplers of the invention and the comparative couplers, which are shown in Table 1, were each taken in an amount of 0.1 mols per mol of silver, and tricresyl phosphate was added in the same amount by weight as that of the respective couplers, and ethyl acetate was then added in an amount by weight three times as large as that of the respective couplers. Each of the resulting mixtures was heated up to 60° C. and was then dissolved completely.

The resulting solutions were each mixed with 1200 ml of an aqueous 5% gelatin solution containing 120 ml of an aqueous 5% solution of Alkanol B (alkylnaphthalene sulfonate manufactured by DuPont) and was then emulsifiably dispersed by a supersonic disperser, so that a emulsion could be obtained. Next, the resulting dispersion was added into 3.8 kg of a green-sensitive silver iodobromide emulsion (with a silver iodide content of 6 mol%) and 120 ml of a 2% 1,2-bis(vinylsulfonyl) ethane solution (with a water:ethanol proportion = 1:1) was added as a layer hardener. After then, the resulting solution was coated over a subbed transparent polyester base and dried up, so that samples shown in Table 1 were obtained. (The amount of silver coated: 20mg/100cm$^2$)

After the resulting samples were each exposed to light through a wedge in an ordinary method, they were each subjected to the following development process. The results thereof are shown in Table 1.

| [Processing steps] | | |
|---|---|---|
| Color developing | 38° C. | 3 min. 15 sec. |
| Bleaching | 38° C. | 4 min. 20 sec. |
| Washing | 38° C. | 3 min. 15 sec. |
| Fixing | 38° C. | 4 min. 20 sec. |
| Washing | 38° C. | 3 min. 15 sec. |
| Stabilizing | 38° C. | 1 min. 30 sec. |
| Drying | 47° C. ± 5° C. | 16 min. 30 sec. |

In the above-mentioned processing steps, the compositions of the processing solutions used therein were as follows.

| | |
|---|---|
| (Composition of the color developer) | |
| Potassium carbonate | 30.0 g |
| Sodium hydrogencarbonate | 2.5 g |
| Potassium sulfite | 5.0 g |
| Potassium bromide | 1.3 g |
| Potassium iodide | 2.0 g |
| Hydroxylamine sulfate | 2.5 g |
| Sodium chloride | 0.6 g |
| Sodium diethylenetriaminepentaacetate | 2.5 g |
| 3-methyl-4-amino-N-ethyl-N-(β-hydroxyethyl) aniline sulfate | 48 g |
| Potassium hydroxide | 1.2 g |
| Add water to make | 1 liter |
| Adjust pH with potassium hydroxide or a 20% sulfuric acid solution to be | pH 10.06 |
| (Composition of the bleaching solution) | |
| Iron ammonium ethylenediamine tetraacetate | 100.0 g |
| Ethylenediamine tetraacetic acid | 10.0 g |
| Ammonium bromide | 150.0 g |
| Glacial acetic acid | 40.0 ml |
| Sodium bromide | 10.0 g |
| Add water to make | 1 liter |
| Adjust pH with aqueous ammonia or glacial acetic acid to be | pH 3.5 |
| (Composition of the fixing solution) | |
| Ammonium thiosulfate | 180.0 g |
| Sodium sulfite, anhydrous | 12.0 g |
| Sodium metabisulfite | 2.5 g |
| Disodium ethylenediaminetetraacetate | 0.5 g |
| Sodium carbonate | 10.0 g |
| Add water to make | 1 liter |
| (Composition of the stabilizing solution) | |
| Formalin (in an aqueous 37% solution) | 2.0 g |
| Konidux (manufactured by Konica Corp.) | 5.0 g |
| Add water to make | 1 liter. |

Comparative coupler 1

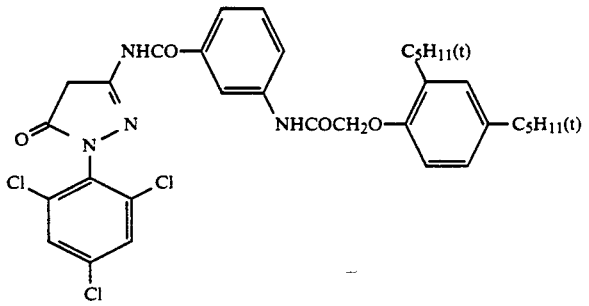

-continued

Comparative coupler 2

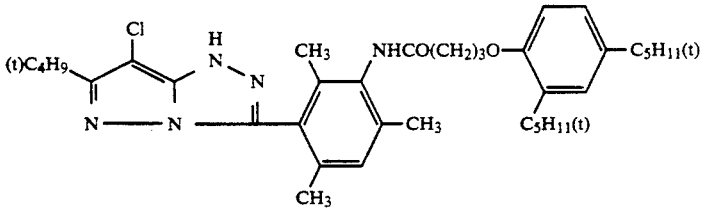

(Compound given in Japanese Patent O.P.I. Publication No. 61-292143/1986)

Comparative coupler 3

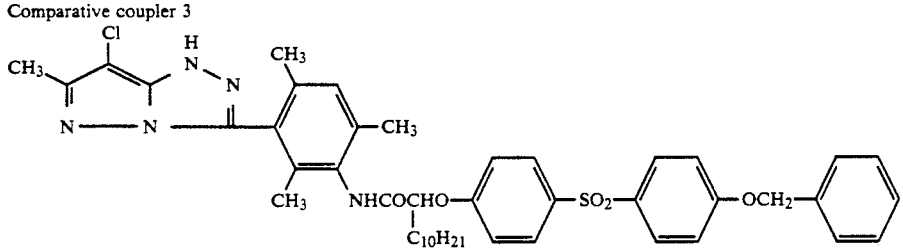

(Compound given in U.S. Pat. No. 4,942,117)

TABLE 1

| Sample No. | Coupler | Specific sensitivity | Maximum density | Fog |
|---|---|---|---|---|
| 1 Comparison | Comparison 1 | 100 | 1.50 | 0.12 |
| 2 Comparison | Comparison 2 | 87 | 1.32 | 0.11 |
| 3 Comparison | Comparison 3 | 99 | 1.48 | 0.15 |
| 111 Invention | Exemp. 102 | 105 | 1.55 | 0.10 |
| 112 Invention | Exemp. 103 | 107 | 1.60 | 0.11 |
| 113 Invention | Exemp. 104 | 104 | 1.58 | 0.10 |
| 114 Invention | Exemp. 114 | 100 | 1.49 | 0.10 |
| 115 Invention | Exemp. 123 | 99 | 1.51 | 0.10 |
| 116 Invention | Exemp. 107 | 104 | 1.61 | 0.11 |
| 121 Invention | Exemp. 201 | 110 | 1.62 | 0.09 |
| 122 Invention | Exemp. 202 | 105 | 1.58 | 0.10 |
| 123 Invention | Exemp. 203 | 102 | 1.55 | 0.09 |
| 124 Invention | Exemp. 209 | 98 | 1.48 | 0.10 |
| 125 Invention | Exemp. 214 | 101 | 1.46 | 0.10 |
| 126 Invention | Exemp. 219 | 97 | 1.53 | 0.10 |
| 131 Invention | Exemp. 301 | 106 | 1.55 | 0.08 |
| 132 Invention | Exemp. 302 | 107 | 1.57 | 0.08 |
| 133 Invention | Exemp. 306 | 101 | 1.51 | 0.09 |
| 134 Invention | Exemp. 310 | 103 | 1.53 | 0.10 |
| 135 Invention | Exemp. 314 | 104 | 1.54 | 0.10 |
| 136 Invention | Exemp. 319 | 102 | 1.52 | 0.09 |

1) Specific sensitivity is indicated by the reciprocal of an exposure giving a density of a fog density + 0.1, and the sensitivity of sample 1 was set to be 100 as the standard.

It can be proved from the results shown in Table 1 that the samples relating to the invention had a substantially low fog and the superior characteristics such as a high sensitivity and a high maximum density. Besides, the samples relating to the invention also has an excellent color reproducibility particularly superior to the comparative sample 1.

EXAMPLE 2

As for a comparative multilayered color light sensitive material, sample 10 was prepared by coating each of the layers having the following compositions over a subbed triacetyl cellulose film support, in the coating order from the support. The amounts of each of the compounds are indicated in terms of g/m$^2$, provided, however, that the amounts of the silver halides coated are indicated in terms of the silver contents.

| | |
|---|---|
| Layer 1: An antihalation layer | |
| UV absorbent, U-1 | 0.3 |
| UV absorbent, U-2 | 0.4 |
| High boiling solvent, O-1 | 1.0 |
| Black colloidal silver | 0.24 |
| Gelatin | 2.0 |
| Layer 2: An interlayer | |
| 2,5-di-t-octyl hydroquinone | 0.1 |
| High boiling solvent, O-1 | 0.2 |
| Gelatin | 1.0 |
| Layer 3: A low-speed red-sensitive silver halide emulsion layer | |
| AgBrI (with an AgI content: 4.0 mol % and an average grain-size: 0.25 μm) spectrally sensitized with a red sensitizing dyes S-1 and S-2 | 0.5 |
| Coupler, C-1 | 0.3 |
| High boiling solvent, O-2 | 0.6 |
| Gelatin | 1.3 |
| Layer 4: A high-speed red-sensitive silver halide emulsion layer | |
| AgBrI (with an AgI content: 2.5 mol % and an average grain-size: 0.6 μm) spectrally sensitized with a red sensitizing dyes S-1 and S-2 | 0.8 |
| Coupler, C-1 | 1.0 |
| High boiling solvent, O-2 | 1.2 |
| Gelatin | 1.8 |
| Layer 5: An interlayer | |
| 2,5-di-t-octyl hydroquinone | 0.1 |
| High boiling solvent, O-1 | 0.2 |
| Gelatin | 0.9 |
| Layer 6: A low-speed green-sensitive silver halide emulsion layer | |
| AgBrI (with an AgI content: 3.5 mol % and an average grain-size: 0.25 μm) spectrally sensitized with a green sensitizing dyes S-3 and S-4 | 0.6 |
| Coupler, MA-1 | 0.15 |
| Coupler, MA-2 | 0.04 |
| High boiling solvent, O-3 | 0.25 |
| Gelatin | 1.4 |
| Layer 7: A high-speed green-sensitive silver halide emulsion layer | |
| AgBrI (with an AgI content: 2.5 mol % and an average grain-size: 0.6 μm) spectrally | 0.9 |

-continued

| | |
|---|---|
| sensitized with a green sensitizing dyes S-3 and S-4 | |
| Coupler. MA-1 | 0.56 |
| Coupler, MA-2 | 0.12 |
| High boiling solvent, O-3 | 1.0 |
| Gelatin | 1.5 |
| Layer 8: An interlayer | |
| The same as Layer 5 | |
| Layer 9: A yellow filtering layer | |
| Yellow colloidal silver | 0.1 |
| Gelatin | 0.9 |
| 2,5-di-t-octyl hydroquinone | 0.1 |
| High boiling solvent, O-1 | 0.2 |
| Layer 10: A low-speed blue-sensitive silver halide emulsion layer | |
| AgBrI (with an AgI content: 2.5 mol % and an average grain-size: 0.35 μm) spectrally sensitized with a blue sensitizing dye S-5 | 0.6 |
| Coupler. Y-1 | 1.4 |
| High boiling solvent, O-3 | 0.6 |
| Gelatin | 1.3 |
| Layer 11: A high-speed blue-sensitive silver halide emulsion layer | |
| AgBrI (with an AgI content: 2.5 mol % and an average grain-size: 0.9 μm) spectrally sensitized with a blue sensitizing dye S-5 | 0.9 |
| Coupler. Y-1 | 3.5 |
| High boiling solvent, O-3 | 1.4 |
| Gelatin | 2.1 |
| Layer 12: The first protective layer | |
| UV absorbent, U-1 | 0.3 |
| UV absorbent, U-2 | 0.4 |
| 2,5-di-t-octyl hydroquinone | 0.1 |
| High boiling solvent, O-3 | 0.6 |
| Gelatin | 1.2 |
| Layer 13: The second protective layer | |
| A non-light sensitive silver halide emulsion comprising silver iodobromide having a silver iodide content of 1 mol % and having an average grain-size (r) of 0.08 μm | 0.3 |
| Polymethyl methacrylate particles, having a particle diameter of 1.5 μm | 0.06 |
| Surfactant, SA-1 | 0.004 |
| Gelatin | 0.7 |

Besides the above-given compounds, gelatin hardeners H-1 and H-2, surfactant SA-1 and antiseptic DI-1 were also added into each of the layers.

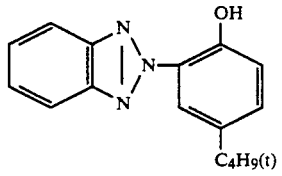

U-1

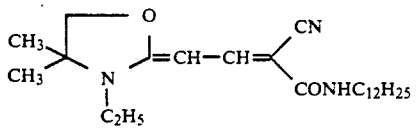

U-2

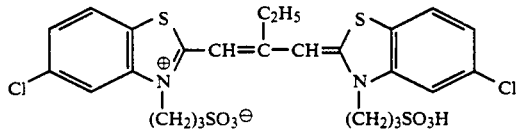

Sensitizing dye S-1

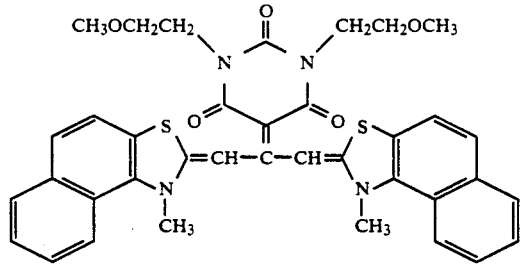

Sensitizing dye S-2

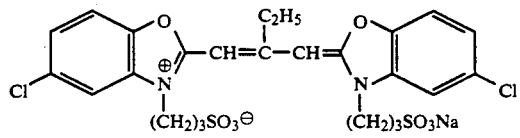

Sensitizing dye S-3

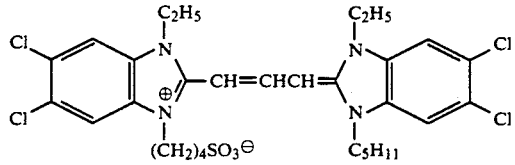

Sensitizing dye S-4

-continued
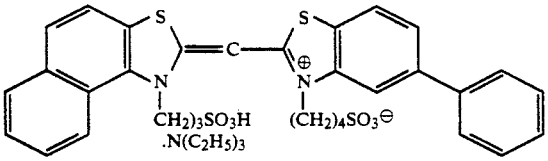
Sensitizing dye S-5
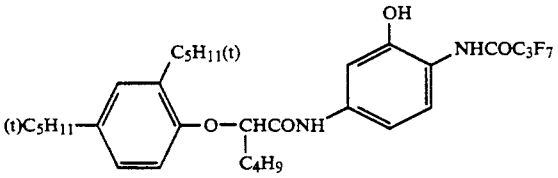
Coupler C-1
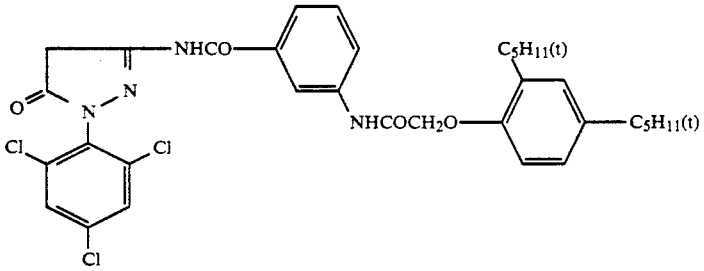
Coupler MA-1
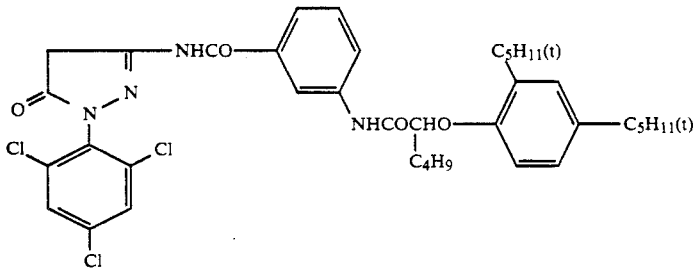
Coupler MA-2
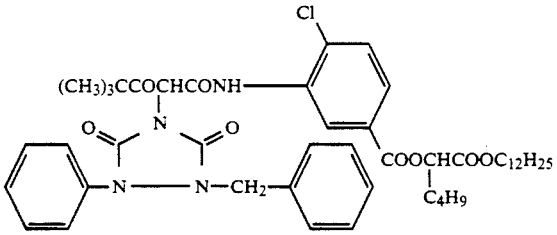
Coupler Y-1
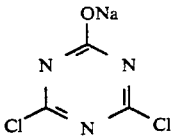
Gelatin hardener H-1
$[(CH_2{=}CHSO_2CH_2)_3CCH_2SO_2(CH_2)_2]_2N(CH_2)_2SO_3K$
Gelatin Hardener H-2
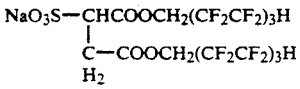
Surfactant SA-1
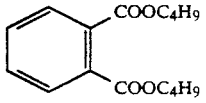
High boiling solvent O-1

-continued

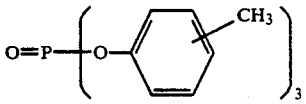

O-2

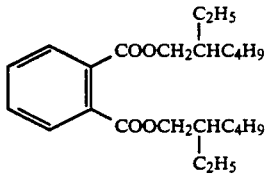

O-3

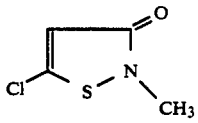

and

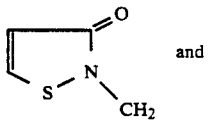

and

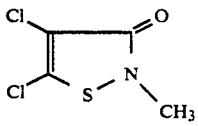

Antiseptic DI-1

Next, samples 11 through 21 were each prepared in the same manner as in sample 10, except that the magenta couplers MA-1 and MA-2 contained in layers 6 and 7 of sample 10 were replaced by the couplers added in the total mol amount of MA-1 and MA-2 as shown in Table-2.

The resulting samples 11 through 21 were exposed to white light through a step-wedge for sensitometric use and were then processed in the following processing steps A.

| Processing step | Processing time | Processing temperature |
|---|---|---|
| 1st developing | 6 min. | 38° C. |
| Washing | 2 min. | 38° C. |
| Reversing | 2 min. | 38° C. |
| Color developing | 6 min. | 38° C. |
| Conditioning | 2 min. | 38° C. |
| Bleaching | 6 min. | 38° C. |
| Fixing | 4 min. | 38° C. |
| Washing | 4 min. | 38° C. |
| Stabilizing | 1 min. | at an ordinary temp. |
| Drying | | |

The compositions of the processing solutions used in the above-given processing steps were as follows.

| | |
|---|---|
| The first developer | |
| Sodium tetrapolyphosphate | 2 g |
| Sodium sulfite | 20 g |
| Hydroquinone monosulfonate | 30 g |
| Sodium carbonate, monohydrate | 30 g |
| 1-phenyl-4-methyl-4-hydroxymethyl 3-pyrazolidone | 2 g |
| Potassium bromide | 2.5 g |
| Potassium thiocyanate | 1.2 g |
| Potassium iodide, (in a 0.1% solution) | 2 ml |
| Add water to make, (at a pH of 9.60) | 1000 ml |
| Reversal solution | |

-continued

| | |
|---|---|
| Hexasodium nitrilotrimethylenephosphonate | 3 g |
| Stannous chloride, dihydrate | 1 g |
| p-aminophenol | 0.1 g |
| Sodium hydroxide | 8 g |
| Glacial acetic acid | 15 ml |
| Add water to make (at a pH of 5.75) | 1000 ml |
| Color developing solution | |
| Sodium tetrapolyphosphate | 3 g |
| Sodium sulfite | 7 g |
| Tertiary sodium phosphate, dihydrate | 36 g |
| Potassium bromide | 1 g |
| Potassium iodide, (in a 0.1% solution) | 90 ml |
| Sodium hydroxide | 3 g |
| Citradinic acid | 1.5 g |
| N-ethyl-N-β-methanesulfonamidoethyl-3-methyl-4-aminoaniline sulfate | 11 g |
| 2,2-ethylenedithiodiethanol | 1 g |
| Add water to make (at a pH of 11.70) | 1000 ml |
| Conditioner | |
| Sodium sulfite | 12 g |
| Sodium ethylenediaminetetraacetate, dihydrate | 8 g |
| Thioglycerol | 0.4 ml |
| Glacial acetic acid | 3 ml |
| Add water to make (at a pH of 6.15) | 1000 ml |
| Bleaching solution | |
| Sodium ethylenediaminetetraacetate, dihydrate | 2 g |
| Iron (III) ammonium ethylenediamine-tetraacetate, dihydrate | 120 g |
| Ammonium bromide | 100 g |
| Add water to make (at a pH of 5.65) | 1000 ml |
| Fixing solution | |
| Ammonium thiosulfate | 80 g |
| Sodium sulfite | 5 g |
| Sodium bisulfite | 5 g |
| Add water to make (at a pH of 6.60) | 1000 ml |
| Stabilizer | |
| Formalin (in a 37 wt % solution) | 5 ml |
| Konidux, manufactured by Konica Corp. | 5 ml |
| Add water to make | 1000 ml |

On the samples having the images obtained in the above-mentioned process, the maximum densities and sensitive speeds of the magenta images were measured, respectively. The results of the measurements are shown in Table-2. The specific sensitivity was a sensitivity obtained at a density of 1.0, and the sensitive speed of sample 10 was regarded as a value of 100 as the standard speed.

It was proved from the results shown in Table-2 that the samples relating to the invention are high in both of the sensitive speeds and the maximum densities so as to display the excellent characteristics. It was also proved that the samples of the invention provided the excellent color reproducibility particularly in comparison with sample 10. In addition to the above, After the color images obtained from samples 10 through 12, 211 through 218 and 221 through 229 were each stored for 2 hours at 60° C. and 70% RH, the increases in stains produced thereon were measure. It was, resultingly, proved that the samples of the invention can reduce the stain production so as to display the excellent characteristics in comparison with comparative samples 10 through 12.

Similar to the cases of samples 221 through 229, the samples were prepared by making use of exemplified compounds 114 to 116, 118, 120 to 122, 125, 208, 213, 216, 218, 220 and 223 and the resulting samples were processed, respectively. Resultingly, they were also proved to display the effects of the invention.

TABLE-2

| Sample No. | Coupler | Specific sensitivity | Maximum density |
|---|---|---|---|
| 20 Comparison | MA-1 and MA-2 | 100 | 3.02 |
| 21 Comparison | Comparison 2 | 105 | 2.60 |
| 22 Comparison | Comparison 3 | 98 | 2.96 |
| 23 Invention | Exemplified 101 | 108 | 3.08 |
| 211 Invention | Exemplified 102 | 110 | 3.11 |
| 212 Invention | Exemplified 104 | 105 | 3.06 |
| 213 Invention | Exemplified 105 | 106 | 3.08 |
| 214 Invention | Exemplified 107 | 109 | 3.10 |
| 215 Invention | Exemplified 118 | 97 | 2.98 |
| 216 Invention | Exemplified 123 | 113 | 3.04 |
| 217 Invention | Exemplified 111 | 105 | 3.09 |
| 218 Invention | Exemplified 108 | 99 | 3.01 |
| 221 Invention | Exemplified 201 | 110 | 3.14 |

TABLE-2-continued

| Sample No. | Coupler | Specific sensitivity | Maximum density |
|---|---|---|---|
| 222 Invention | Exemplified 202 | 112 | 3.10 |
| 223 Invention | Exemplified 203 | 108 | 3.12 |
| 224 Invention | Exemplified 204 | 99 | 2.97 |
| 225 Invention | Exemplified 209 | 97 | 2.99 |
| 226 Invention | Exemplified 214 | 98 | 2.94 |
| 227 Invention | Exemplified 217 | 96 | 3.02 |
| 228 Invention | Exemplified 219 | 110 | 3.00 |
| 229 Invention | Exemplified 207 | 101 | 3.03 |
| 231 Invention | Exemplified 302 | 114 | 3.15 |
| 232 Invention | Exemplified 303 | 113 | 3.13 |
| 233 Invention | Exemplified 305 | 101 | 2.99 |
| 234 Invention | Exemplified 310 | 108 | 3.11 |
| 235 Invention | Exemplified 314 | 109 | 3.11 |
| 236 Invention | Exemplified 315 | 107 | 3.07 |
| 237 Invention | Exemplified 316 | 108 | 3.09 |
| 238 Invention | Exemplified 320 | 105 | 3.03 |
| 239 Invention | Exemplified 322 | 100 | 2.98 |

What is claimed is:

1. A color photographic material comprising a support and a light sensitive silver halide emulsion layer said color photographic material further comprising a coupler represented by a formula I:

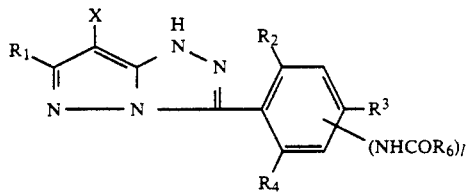

I wherein, $R_1$ represents a primary alkyl group; $R_2$, $R_3$ and $R_4$ represent each an alkyl group, an alkoxy group or a halogen atom; $R_6$ is a straight or branched non-substituted alkyl group having 8 to 18 carbon atoms;

X represents a hydrogen atom or a releasing group; and l is an integer of 1 or 2.

2. A color photographic material as claimed in claim 1, wherein $R_1$ is a methyl group.

3. A color photographic material as claimed in claim 1, wherein $R_2$, $R_3$ and $R_4$ are each an alkyl group.

4. A color photographic material as claimed in claim 3, wherein $R_2$, $R_3$ and $R_4$ are each a methyl group.

* * * * *